US008289526B2

(12) United States Patent
Kilian et al.

(10) Patent No.: US 8,289,526 B2
(45) Date of Patent: Oct. 16, 2012

(54) SYSTEM AND METHOD FOR ANALYZING ROLLING STOCK WHEELS

(75) Inventors: Krzysztof Kilian, Colorado Springs, CO (US); Vladimir Mazur, Floreat (AU); Stuart Hall, Perth (AU)

(73) Assignee: LynxRail Corporation, Colorado Springs, CO (US)

( * ) Notice: Subject to any disclaimer, the term of this patent is extended or adjusted under 35 U.S.C. 154(b) by 404 days.

(21) Appl. No.: 12/175,166

(22) Filed: Jul. 17, 2008

(65) Prior Publication Data

US 2009/0040503 A1 Feb. 12, 2009

Related U.S. Application Data

(60) Provisional application No. 60/950,216, filed on Jul. 17, 2007.

(51) Int. Cl.
*G01B 11/24* (2006.01)

(52) U.S. Cl. ..... 356/601; 356/237.1; 356/237.6

(58) Field of Classification Search ..... 356/601, 356/237.1–237.5
See application file for complete search history.

(56) References Cited

U.S. PATENT DOCUMENTS

| | | | | |
|---|---|---|---|---|
| 3,206,596 | A | 9/1965 | Howell | |
| 3,253,140 | A | 5/1966 | Sibley et al. | |
| 4,798,963 | A * | 1/1989 | Wittkopp et al. | 250/559.22 |
| 4,798,964 | A * | 1/1989 | Schmalfuss et al. | 250/559.22 |
| 4,972,494 | A * | 11/1990 | White et al. | 382/143 |
| 5,247,338 | A | 9/1993 | Danneskiold-Samsoe et al. | |
| 5,448,072 | A | 9/1995 | Gallagher | |
| 5,596,203 | A | 1/1997 | Zingarelli et al. | |
| 5,636,026 | A * | 6/1997 | Mian et al. | 356/602 |
| 5,677,533 | A | 10/1997 | Yaktine et al. | |
| 5,793,492 | A * | 8/1998 | Vanaki | 356/613 |
| 5,936,737 | A * | 8/1999 | Naumann | 356/613 |
| 6,768,551 | B2 | 7/2004 | Mian et al. | |
| 6,823,242 | B1 | 11/2004 | Ralph | |
| 6,872,945 | B2 | 3/2005 | Bartonek | |
| 6,909,514 | B2 | 6/2005 | Nayebi | |
| 6,911,914 | B2 | 6/2005 | Mathews, Jr. et al. | |
| 7,564,569 | B2 * | 7/2009 | Mian et al. | 356/601 |
| 7,714,886 | B2 * | 5/2010 | Kilian et al. | 348/135 |
| 2006/0010971 | A1 | 1/2006 | Kilian et al. | |
| 2007/0064244 | A1 | 3/2007 | Mian et al. | |

FOREIGN PATENT DOCUMENTS

WO WO 2006/010154 A2 1/2006

OTHER PUBLICATIONS

International Search Report and Written Opinion of International Searching Authority, PCT/US08/70318, Oct. 22, 2008.

* cited by examiner

*Primary Examiner* — Tarifur Chowdhury
*Assistant Examiner* — Isiaka Akanbi
(74) *Attorney, Agent, or Firm* — Boardman & Clark LLP

(57) ABSTRACT

An exemplary system and method for analyzing rolling stock wheels helps allow a wheel to be analyzed at speed, reducing any need for manual inspections or other related delays. An exemplary system may include one or more strobe lights and one or more high-speed cameras to capture images of the rolling stock wheel(s) at speed. The images may include one or more markers to assist in analyzing various parameters of the rolling stock wheel. The exemplary system may include one or more backface illumination plates to assist in illuminating the rolling stock wheel(s) and/or the one or more marker(s).

20 Claims, 4 Drawing Sheets

SYSTEM AND METHOD FOR ANALYZING ROLLING STOCK WHEELS

This application claims priority to U.S. Provisional Application 60/950,216 filed Jul. 17, 2007, which is incorporated herein by reference in its entirety.

BACKGROUND

1. Field

The present invention relates to a system and method for analyzing rolling stock wheels. The present invention more specifically relates to a system and method involving multiple cameras and lighting for measuring the profiles of such wheels.

2. Related Art

The rolling stock of a railroad, such as box cars, flat cars, tanker cars, hopper cars, gondolas, piggy back carriers for semi-tractor trailers and/or containers, passenger cars, and the like, are subject to wear, fatigue and the like. This is especially true of the wheels and trucks of such rolling stock. Accordingly, it is typically necessary or desirable to inspect such rolling stock, and especially the trucks and wheels of such rolling stock, on occasion to insure that the rolling stock remains safe to use and is not likely to experience a breakdown in the interval between the current inspection and the next inspection of that piece of rolling stock.

Traditionally, such inspections were performed manually. Not only was such manual inspection time consuming and expensive, it was difficult to insure that a given piece of rolling stock was inspected on any reasonable schedule.

Accordingly, as set forth in U.S. Pat. Nos. 6,911,914; 6,909,514; 6,872,945; 6,823,242; 6,768,551; 5,793,492; 5,677,533; 5,596,203; 5,448,072; 5,247,338; 3,253,140; and 3,206,596, each of which is incorporated herein by reference for its teachings, over the last thirty years, various systems and methods have been developed for automatically inspecting various aspects and parameters of railway rolling stock, such as railroad wheel and bearing temperatures, hot rail car surfaces, wheel profiles, and the like. Conventionally, such systems and methods have used passive sensors that generate a 1-dimensional, time-varying signal as the piece of rolling stock passes by the sensor. To provide additional dimensional information, multiple sensors can be arranged either along or perpendicular to the railway rail. More recently, optical-based systems that generate 2-dimensional images of various components of railway rolling stock, such as wheels, truck assemblies, car bodies of the rolling stock and the like, have been used to inspect such rolling stock.

Some optical-based systems provide for laser-based rolling stock wheel profile measuring systems. Such systems (often installed way side) typically derive wheel profile measurements by projecting laser lines onto a surface of the wheel and then capturing an image of the wheel surface with the laser line projected onto it. However, such known systems do not realize certain advantageous features (and/or combinations of features).

For example, the accuracy of measurements obtained using such laser systems is highly dependent on the calibration of the systems. Even minor changes in the setup and/or calibration may not be detectable immediately, therefore increasing the risk of unreliable data. Visual review or other manual processing of an object captured in the image is difficult because any image obtained using such systems is directed primarily to a projected laser line on the object, rather than an image of the object itself. As a result, any such processing is difficult, unreliable and has reduced value. For example, known systems typically derive certain wheel parameters (such as wheel hollowing) by assumption because the wheel parameter may not be clearly seen in images captured by such systems.

Such known systems often require correct calibration of the object to be measured. If the actual object being measured differs from the object that was calibrated, then errors are likely. Further, rolling stock wheels typically vary in size. Such variation typically requires interpolation and/or extrapolation, which may introduce errors.

The apparatus of such systems is typically subjected to vibration from passing rolling stock. Large vibrations may result in movement including relative movement between the laser line and the optical center of the image capturing apparatus. Such vibration and movements can lead to or result in errors.

Further, the laser line(s) of such known systems intended to overlay parent material of the rolling stock wheel may instead overlay foreign materials that are not part of the wheel (e.g. grease on the flanges from lubricators, etc.). Because typical processing algorithms assume that the laser line overlays only the parent material of the wheel, foreign material may negatively affect the accuracy and reliability of any measurements obtained from such systems.

The lasers of such known systems also present a potential safety hazard. While such systems typically include protective measures in the event of a system failure, such protective measures cannot eliminate the risk of laser exposure.

It would be desirable to provide a system, method or the like for capturing, measuring and/or analyzing rolling stock wheel parameters of the type disclosed in the present application that includes any one or more of these or other advantageous features: a system and/or method that does not substantially depend upon detailed calibration of the system or of the object to be measured; a system and/or method that is affected little by foreign materials that are not part of the original rolling stock wheel; a system and/or method that does not utilize lasers and thereby eliminates the risks of exposure to such lasers; and a system and/or method that does not need to derive wheel parameters by assumption but instead may accurately measure complete wheel parameters including wheel hollowing.

Such systems and methods for capturing, measuring and/or analyzing rolling stock wheel parameters would be advantageous for a number of reasons. These reasons include allowing the systems, or inspection stations that utilize such systems, to be located at points where most rolling stock is likely to be inspected at reasonable intervals, such as the entrances or exits to rail yards, without having to significantly involve railroad personnel in the actual inspection. Furthermore, such systems and methods are designed to inspect the rolling stock at speed. That is, the inspection can occur while the rolling stock moves at its normal rate of travel past the inspection station. In contrast, manual inspections typically require the rolling stock to be stopped to allow the railway personnel access to the various components to make the measurements. By allowing the rolling stock to move at speed through the inspection station, the inspection can occur without substantially negatively affecting the schedule of a particular train, thus reducing the cost of the inspection and delays in transporting goods.

Additionally, such systems and methods would avoid several limitations and/or disadvantages of laser-based systems and/or are inherently safer than laser-based systems.

SUMMARY

The present invention relates to a system for capturing, measuring and/or analyzing rolling stock wheel parameters comprising a first flange camera provided adjacent a track side of a first rail, wherein the first flange camera is positioned to capture an image of at least a portion of a first wheel above the first rail; a first inside rim camera provided adjacent a track side of a second rail, wherein the first inside rim camera is positioned to capture an image of at least a portion of the first wheel; a first outside rim camera provided adjacent a field side of the first rail, wherein the first outside rim camera is positioned to capture an image of at least a portion of the first wheel including at least a portion of an internal diameter of the first wheel; at least one strobe light positioned to help illuminate at least a portion of the first wheel; and at least one backface illumination plate provided adjacent the track side of the first rail and positioned to reflect light toward the first wheel.

The present invention relates to a method of capturing, measuring and analyzing rolling stock wheel parameters, comprising reflecting light toward a first wheel with a backface illumination plate provided adjacent a track side of a first rail; capturing an image of at least a portion of the first wheel above the first rail with a first flange camera provided adjacent the track side of the first rail; capturing an image of at least a portion of the first wheel above the first rail with a first inside rim camera provided adjacent a track side of a second rail; and capturing an image of at least a portion of the first wheel above the first rail, including at least a portion of an internal diameter of the first wheel, with a first outside rim camera provided adjacent a field side of the first rail.

The present invention relates to a method of providing a system for capturing, measuring and analyzing rolling stock wheel parameters, comprising positioning and orienting a first flange camera adjacent a track side of a first rail to capture an image of at least a portion of a first wheel above the first rail; positioning and orienting a first inside rim camera adjacent a track side of a second rail to capture an image of at least a portion of the first wheel above the first rail; positioning and orienting a first outside rim camera adjacent a field side of the first rail to capture an image of at least a portion of the first wheel above the first rail; positioning and orienting at least one strobe light, such that the at least one strobe light helps illuminate at least a portion of the first wheel; and positioning and orienting at least one backface illuminate plate adjacent the track side of the first rail to reflect light toward the first wheel.

These and other features and advantages of various exemplary embodiments of systems and methods according to these inventions are described in, or are apparent from, the following detailed descriptions of various exemplary embodiments of various devices, structures and/or methods according to this invention.

BRIEF DESCRIPTION OF DRAWINGS

Various exemplary embodiments of the systems and methods according to this invention will be described in detail, with reference to the following figures, wherein.

Figure 2:
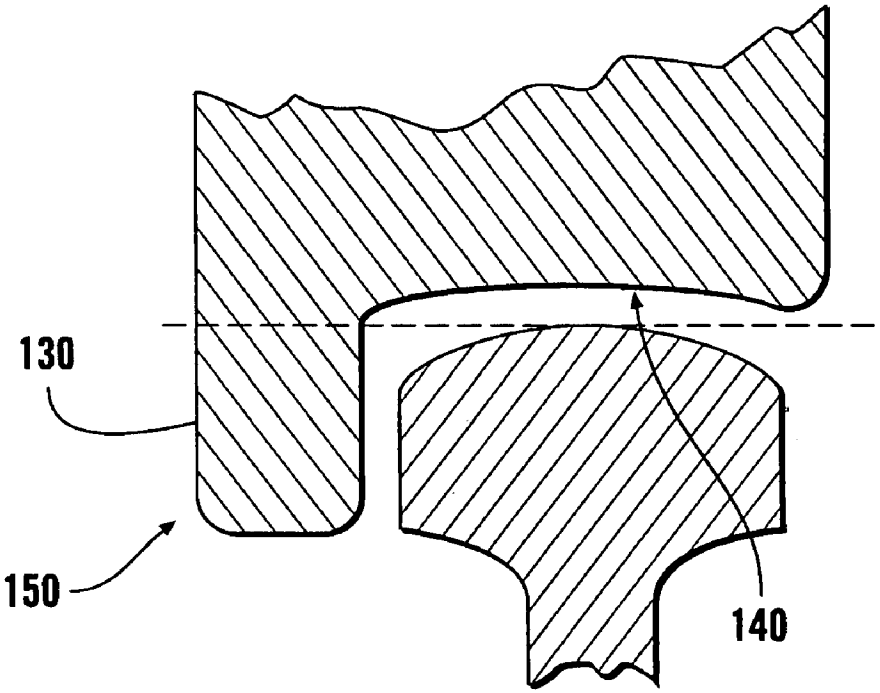
FIG. 2 is a partial sectional view of a wheel profile of a rolling stock wheel positioned on a rail.

It should be understood that the drawings are not necessarily to scale. In certain instances, details that are not necessary for an understanding of the invention or render other details difficult to perceive may have been omitted. It should be understood, of course, the invention is not necessarily limited to the particular embodiments illustrated herein.

DETAILED DESCRIPTION

A railroad can own tens of thousands, if not more, of pieces of rolling stock. Such rolling stock includes both locomotives and freight and/or passenger cars. Typically, a railroad owns dozens of different types of freight cars, such as box cars, tanker cars, gondolas, hoppers, flat cars, piggy-back flat cars, container carriers, livestock cars and the like. If a railway provides passenger service, the rolling stock can contain passenger cars, baggage cars, mail cars, sleeper cars, dining cars, observation cars and the like. Inspecting rolling stock is typically problematic (e.g. due to its mobile nature). Accordingly, as outlined in the above-incorporated U.S. patents, automatically inspecting rolling stock as it passes by an inspection station can be more efficient than manually inspecting the rolling stock.

As outlined above, while manually inspecting the rolling stock can provide very precise and accurate measurement of various parameters associated with the rolling stock, such manual measurements are time consuming and expensive. Not only does manual inspection require trained personnel, manual inspection requires stopping a train containing the rolling stock for a period of time. Because railways earn profits by moving goods from one place to another, delays for inspecting the rolling stock can negatively impact the railway (e.g. directly reduce the profits earned by the railway).

In various embodiments, systems including machine vision absent any laser lines are utilized due to known disadvantages of laser line technology and systems. Laser-based systems unnecessarily complicate wheel profile measurements and increase the risk of erroneous measurements. Further, the laser-included systems also present a potential safety hazard (risk of laser exposure in the case any protective system fails).

In various embodiments, the system related to the present invention utilizes strobe lighting and high-speed cameras (without lasers) to capture parameters of rolling stock wheels. In various embodiments, the system provides accurate measurements of the complete profile and wheel head of the wheel, including wheel hollowing measurements. The system does not require assumptions to derive wheel parameters, but uses parameters captured from images, thereby improving the maintenance practices of the railroads by providing railroad operators with a reliable and easy-to-maintain wheel profile and wheel parameter measuring system, and increasing the safety of railroad operations. In addition, the system is capable of measuring all wheels of a various rolling stock traveling at normal speeds, e.g. at least 60 miles per hour.

Figure 1:
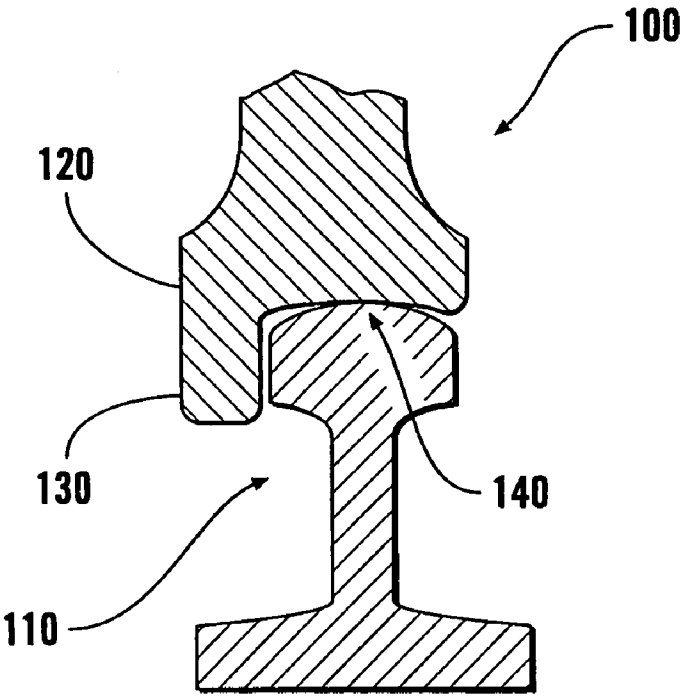
FIG. 1 is a sectional view of a portion of a wheel head on a rail.

FIG. 1 illustrates a sectional view of a rolling stock wheel head 100 atop a rail 110. Wheel head 100 typically includes a rim 120 and a flange 130. Wheel head 100 also typically includes a running surface 140, which generally includes a portion of rim 120 in contact with rail 110. Because wheels are known to move relative to a rail, running surface 140 of a wheel may be wider than a rail and may change over time and/or during the use.

FIG. 2 illustrates a wheel profile 150 of a rolling stock wheel above a rail. If a wheel profile 150 is accurately known or measurable, a variety of wheel parameters such as thickness of the rim, height and width of flange 130, and wheel hollowing may be determined. Wheel hollowing is generally considered a reduction in the thickness of the rim substantially near running surface 140 of the wheel head. Wheel profile 150 illustrated in FIG. 2 exhibits wheel hollowing.

Figure 3:
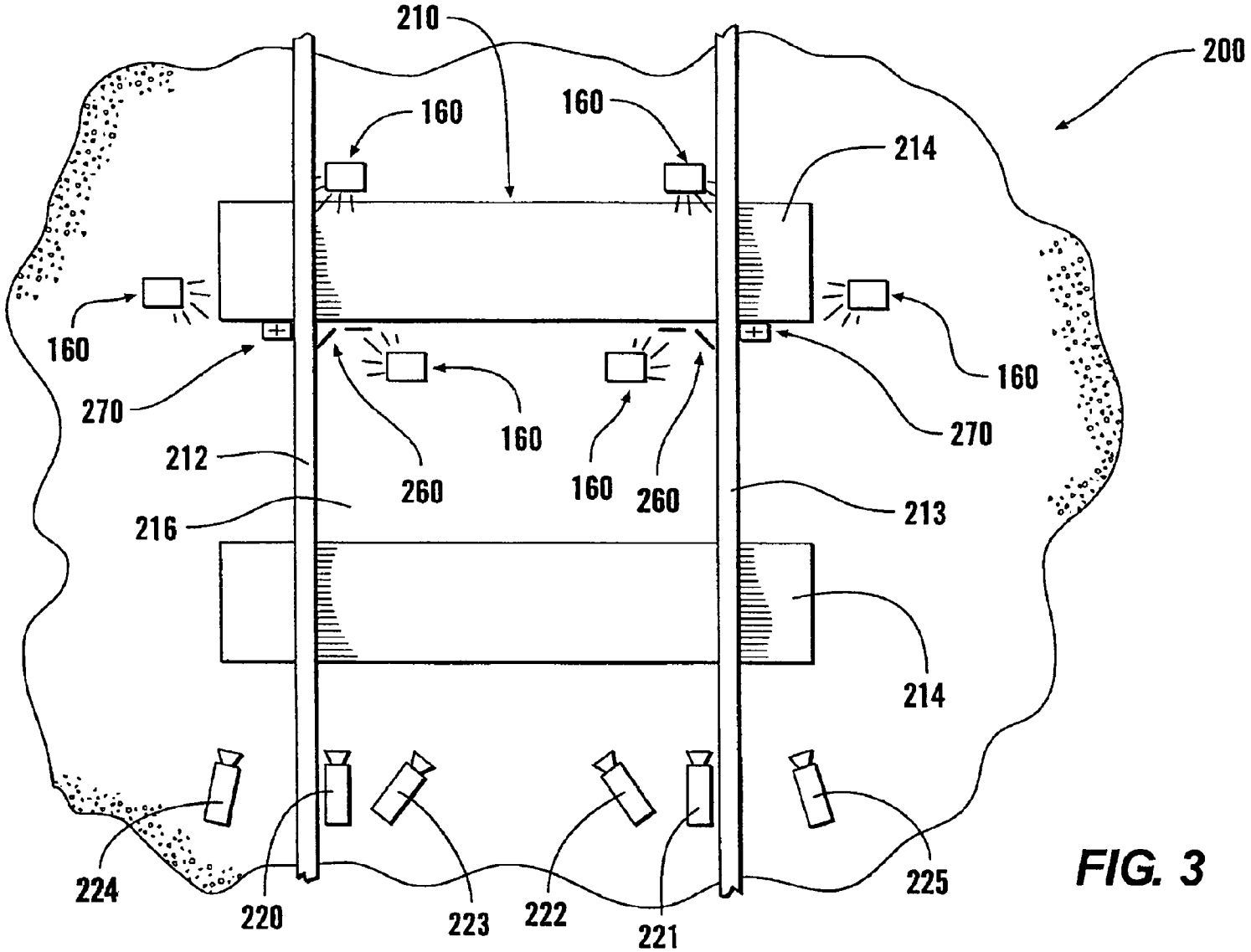
FIG. 3 is a top view of an exemplary embodiment of a system for capturing, measuring and/or analyzing rolling stock wheel parameters.

FIG. 3 shows an exemplary embodiment of an inspection station 200, as a system for capturing, measuring and/or analyzing rolling stock wheel parameters, according to this invention. As shown in FIG. 3, in one exemplary embodiment, inspection station 200 comprises a section 210 of track where a variety of image capture devices, including a first flange camera 220, a second flange camera 221, a first inside rim camera 222, a second inside rim camera 223, a first outside rim camera 224 and a second outside rim camera 225, are located. In various exemplary embodiments, inspection station 200 also includes strobe lighting 160 and one or more triggering systems in communication with one or more cameras and/or strobe lighting 160. The system may also include one or more data processing units and/or one or more communication links in communication with at least one of the cameras.

As also shown in FIG. 3, in one embodiment, section 210 of track includes portions of a first rail 212 and a second rail 213 that are provided on one or more sleepers 214. Sleepers 214 may be embedded in a mass of ballast 216. Rails 212, 213 may be connected to sleepers 214 using any known or later-developed technique and/or device. As shown in FIG. 3, image capture devices may be located outside one or both of rails 212, 213 (i.e., located to a field side of one or both rails 212, 213) and/or between rails 212, 213 (i.e., located on a track side of rails 212, 213).

In various exemplary embodiments, the various image capturing devices, such as cameras 220-225 shown in FIG. 3, utilized in the system are positioned and/or angled to capture at least portions of wheel heads of wheels of one or more wheel sets. In various exemplary embodiments, the various image capturing devices utilized in the system may also be positioned and/or located to help magnify one or more captured objects.

More specifically, in various exemplary embodiments, first flange camera 220 and second flange camera 221 are provided (e.g. located and positioned) adjacent the track side of a first rail 212 and a second rail 213, respectively, and pointed substantially at a flange of a first wheel and a flange of a second wheel of a wheel set, respectively, and located and positioned so that the wheel set may pass without contacting either camera 220, 221.

Likewise, in various exemplary embodiments, first inside rim camera 222 is provided between first rail 212 and second rail 213 (e.g. adjacent the track side of second rail 213) and oriented (e.g. at a slightly vertical angle and horizontal angle) to allow first inside rim camera 222 to capture an image of at least a portion of a rim of the first wheel, while second inside rim camera 223 is provided between first rail 212 and second rail 213 (e.g. adjacent the track side of first rail 212) and oriented (e.g. at a slightly vertical angle and horizontal angle) to allow second inside rim camera 223 to capture an image of at least a portion of a rim of the second wheel.

Meanwhile, in various exemplary embodiments, first outside rim camera 224 and second outside rim camera 225 are provided to the field side of first rail 212 and second rail 213, respectively, and oriented (e.g. at a slightly vertical angle and horizontal angle) to allow first outside rim camera 224 and second outside rim camera 225 to capture an image of at least a portion of the rim of a first wheel and at least a portion of the rim of a second wheel, respectively.

It should be appreciated that the image capturing devices may be positioned, oriented and aligned any number of ways. In various exemplary embodiments, however, the image capturing devices are positioned, aligned and oriented to help allow the image capturing devices to capture precisely an area of interest, e.g. the majority of a wheel's profile.

It should also be appreciated that the various image capturing devices, such as cameras 220-225, can be implemented by incorporating one or more physically distinct imaging systems, such as complete digital cameras, into an image capture device body. In one embodiment, the various image capturing devices can be implemented as a plurality of physically independent image capture systems, such as complete digital cameras. In one embodiment, the various image capturing devices can implement one or more imaging systems using physically distinct lens assemblies and image capture electronics, with common data storage, input/output control and other electronics. It should be appreciated that any known or later-developed type or types of image capture systems may be used to implement any one of or multiple ones of the various image capturing devices, including cameras 220-225.

Figure 5:
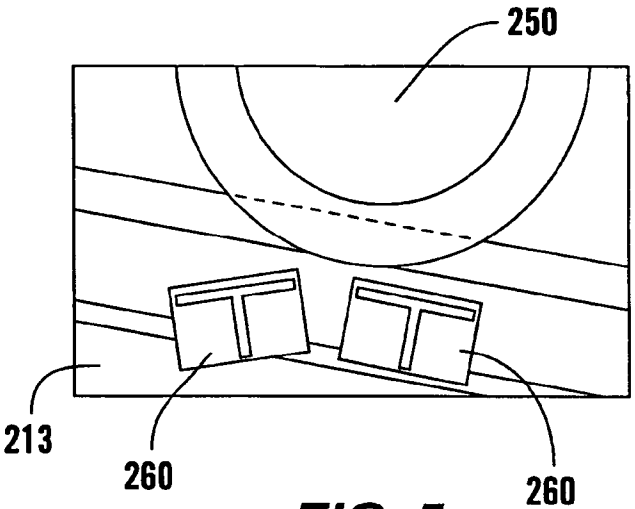
FIG. 5 illustrates an image that may be produced by an inside rim camera of one exemplary embodiment of a system for capturing, measuring and/or analyzing rolling stock wheel parameters.
Figure 4:
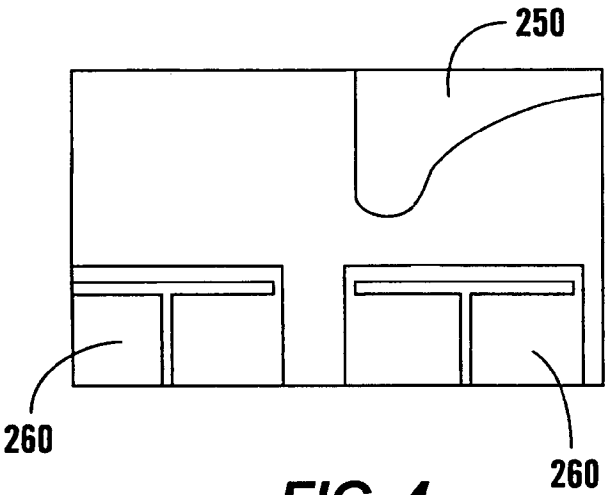
FIG. 4 illustrates an image that may be produced by a flange camera of an exemplary embodiment of a system for capturing, measuring and/or analyzing rolling stock wheel parameters.
Figure 6:
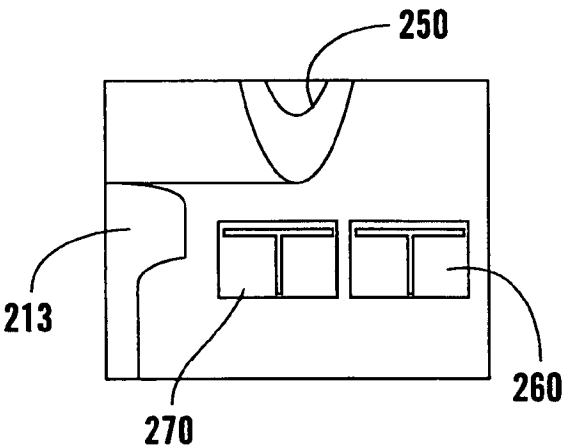
FIG. 6 illustrates an image that may be produced by an outside rim camera of an exemplary embodiment of a system for capturing, measuring and/or analyzing rolling stock wheel parameters.

FIGS. 4-6 illustrate various images that may be captured by three cameras of the system intended to capture images of one or more wheels positioned substantially above, for example, a second rail (e.g., the second flange camera, the second inside rim camera and the second outside rim camera). For example, as shown in FIGS. 4-6, the majority of a profile of a wheel 250 may be viewable and/or measurable utilizing images produced by the second flange camera, the second inside rim camera, and the second outside rim camera. More specifically, as depicted in FIG. 6, at least a portion of an internal diameter of wheel 250 should be visible from the location of an outside rim camera, e.g., the second outside rim camera.

Because wheel 250 is positioned on second rail 213, the second flange camera, second inside rim camera and second outside rim camera may not capture in any of the images the complete running surface of wheel 250. However, any portion of the running surface of wheel 250 that is not captured in the images should be in contact substantially with second rail 213. More particularly, the portion of the running surface of wheel 250 should be in contact with the profile of second rail 213. The profile of second rail 213 may be measured accurately before and after installation of the system and re-measured at regular intervals. For example, a rail typically wears slowly and an annual measurement of the profile of the rail is generally considered sufficient, even under very heavy traffic conditions and use. Because the profile of second rail 213 is known or at least measurable, by combining the profile of second rail 213 with data from images captured by second flange camera 221, second inside rim camera 223, and second outside rim camera 225, a complete or substantially complete "image" of the running surface of wheel 250 may be constructed or determined.

Complete "images" of the running surfaces of other wheels traveling either rail may be similarly determined. In various embodiments, the running surface of a wheel head above the first rail may be determined using the rail profile of the first rail and images captured by the first flange camera, first inside rim camera and first outside rim camera.

Further, from the images and the known rail profile, accurate measurements of wheel parameters including wheel hollowing may be made. Furthermore, a wheel profile may be accurately determined because substantially all of the wheel head is visible on the collective images. All necessary references of the wheel head are visible and, using automated algorithms for image processing, the wheel profile and wheel head may be determined and all wheel profile parameters measured accurately, including wheel hollowing. Once the processing algorithms have determined parameters of the wheel head, the final processing algorithms will include the portion of the wheel that is in contact with the rail, and thus allow determination of the wheel profile and the entire wheel head.

As shown in FIGS. 3-9, the system may also include one or more markers 260 provided about the first and/or second rails, such as those markers disclosed in PCT Patent Application Serial No. PCT/US07/63499, which application is incorporated herein by reference in its entirety. Because such markers 260 may be included in one or more images captured by the system, the correct interrelationships of the images may be more easily determined and, as a result, accurate measurements of the wheel parameters and the wheel profile may be obtained.

More specifically, markers 260 may be located in areas to be captured in the images to enable referencing to the top of the rail or to each of the images. This may ensure more accurate measurements of the wheel parameters (including wheel hollowing) and the wheel profile.

As shown in FIGS. 3 and 6, the system of the present invention may also include one or more sensors 270 such as those disclosed in U.S. Pat. No. 7,278,305 Application Ser. No. 60/588,910, which is incorporated herein by reference in its entirety. Such sensors 270 may be used to determine the existence of any speed variations of each wheel set on a train. In addition, such sensors 270 may be used to improve the timing of the cameras and help ensure that all images are timely captured. Further, where the distances from the cameras to the captured objects are known, all measurements may be corrected for any angle of attack or tracking of the captured objects.

Figure 9:
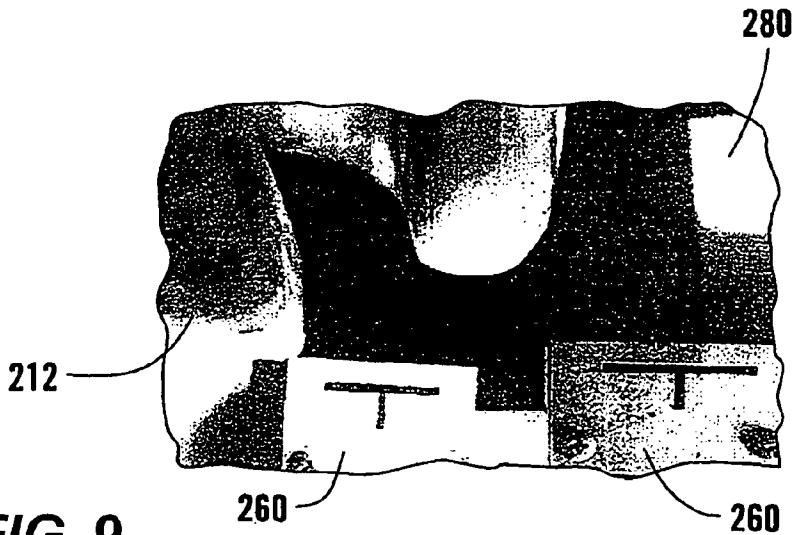
FIG. 9 is a photograph produced by a flange camera of an exemplary embodiment of a system for capturing, measuring and/or analyzing rolling stock wheel parameters, which system includes a backface illumination member.
Figure 7:
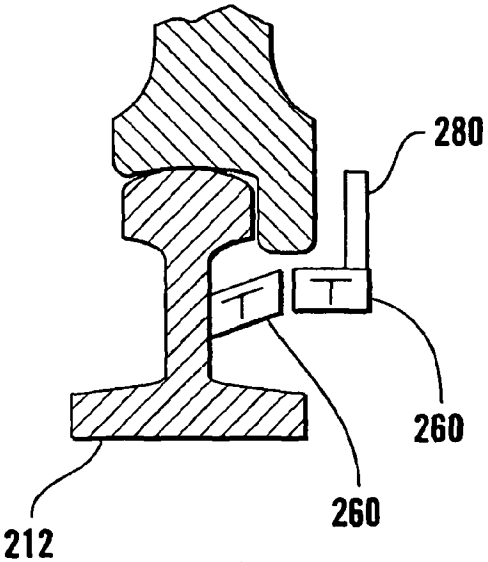
FIG. 7 is a partial sectional view of a backface illumination member and markers positioned about a rail and a wheel head.

As shown in FIGS. 7 and 9, the system may also include one or more backface illumination plates 280 provided between first rail 212 and second rail 213 (e.g. adjacent the track side of first rail 212 and/or second rail 213) and oriented to reflect light toward the flange and/or rim of one or more wheels traveling along first rail 212 and/or second rail 213. For example, backface illumination plate 280 may be mounted vertically and oriented toward the camera 10 to 15 degrees relative to the general longitudinal direction of the rail. In various embodiments, backface illumination plate 280 is provided to avoid contact with any of the wheels. Further, in various embodiments, backface illumination plate 280 may be flexibly mounted (e.g. spring-mounted) so that if it is contacted by the wheel or any components or equipment of rolling stock, it may flex and/or give way and substantially return to its original and/or optimal position. Each backface illumination plate 280 may be constructed of any type of material. In various embodiments, backface illumination plate 280 will be constructed of at least a surface material having reflective characteristics.

Figure 8:
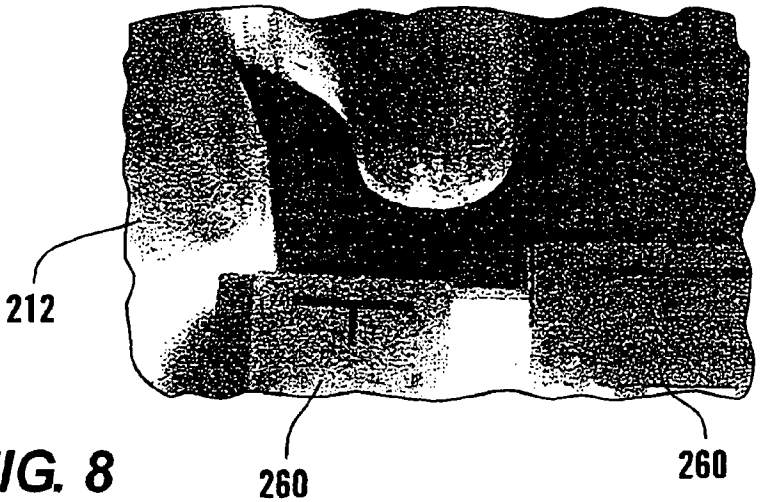
FIG. 8 is a photograph produced by a flange camera of an exemplary embodiment of a system for capturing, measuring and/or analyzing rolling stock wheel parameters.

FIG. 8 is a photograph of first rail 212, a wheel and markers 260 utilizing an exemplary embodiment of a system not including a backface illumination plate. FIG. 9 is a photograph of first rail 212, a wheel and markers 260 captured by an exemplary embodiment of a system including backface illumination plate 280. As shown by FIGS. 8 and 9, in various exemplary embodiments, backface illumination plate 280 helps illuminate at least a portion of a backface of the wheel captured in an image to enhance the quality and clarity of the captured image. In various embodiments, the utilization of backface illumination plate 280 may also help illuminate any markers utilized.

It is important to note that the construction and arrangement of the elements of the system as shown and described in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements and/or elements shown as multiple parts may be integrally formed, the operation of interfaces may be reversed or otherwise varied, the length and/or width of the structures and/or members or connections or other elements of the system may be varied, the nature or number of adjustment positions provided between the elements may be varied, the position of elements may be reversed or otherwise varied, and the nature or number of discrete elements or positions may be altered or varied. It should be noted that the elements and/or assemblies of the system may be constructed from any of a wide variety of materials that provide sufficient strength or durability, in any of a wide variety of colors, textures and combinations. Accordingly, all such modifications are intended to be included within the scope of the present invention. Other substitutions, modifications, changes and omissions may be made in the design, operating conditions and arrangement of the preferred and other exemplary embodiments without departing from the scope of the present inventions.

The invention claimed is:

1. A system for capturing, measuring and analyzing rolling stock wheel parameters, comprising:

a first flange camera provided between a first rail and a second rail, wherein the first flange camera is positioned to capture an image of at least a portion of a first wheel above the first rail, said first wheel having a flange provided between said first rail and said second rail;

a first inside rim camera provided between said first rail and said second rail, wherein the first inside rim camera is positioned to capture an image of at least a portion of said first wheel;

a first outside rim camera provided outside the area between said first rail and said second rail, wherein the first outside rim camera is positioned to capture an image of at least a portion of said first wheel including at least a portion of an internal diameter of said first wheel;

at least one strobe light positioned to illuminate at least a portion of said first wheel; and at least one backface illumination plate provided between said first rail and said second rail and positioned to reflect light toward said first wheel.

2. The system of claim 1, further comprising:

at least one sensor in communication with at least one of the first flange camera, first inside rim camera and first outside rim camera; and at least one marker positioned to be at least partially included in an image of at least a portion of the first wheel captured by at least one of the first flange camera, first inside rim camera and first outside rim camera.

3. The system of claim 1, further comprising a data processing unit in communication with at least one of the first flange camera, first inside rim camera and first outside rim camera.

4. The system of claim 1, further comprising;

a second flange camera provided between said first rail and said second rail, wherein the second flange camera is positioned to capture an image of at least a portion of a second wheel above the second rail, said second wheel having a flange provided between said first rail and said second rail;

a second inside rim camera provided between said first rail and said second rail, wherein the second inside rim camera is position to capture an image of at least a portion of said second wheel:

a second outside rim camera provided outside the area between said first rail and said second rail, wherein the second outside rim camera is positioned to capture an image of at least a portion of said second wheel including at least a portion of an internal diameter of said second wheel;

at least one strobe light positioned to illuminate at least a portion of said second wheel; and at least one backface illumination plate provided between said first rail and said second rail and positioned to reflect light toward said second wheel.

5. The system of claim 4, further comprising:

at least one sensor in communication with at least one of the first flange camera, first inside rim camera, first outside rim camera, second flange camera, second inside rim camera and second outside rim camera; and at least one marker positioned to be at least partially included in an image of at least a portion of the first wheel captured by at least one of the first flange camera, first inside rim camera, first outside rim camera, second flange camera, second inside rim camera and second outside rim camera.

6. The system of claim 4, further comprising a data processing unit in communication with at least one of the first flange camera, first inside rim camera, first outside rim camera, second flange camera, second inside rim camera and second outside rim camera.

7. The system of claim 4, wherein:

the first flange camera includes a camera lens, and the camera lens is aimed at a non-orthogonal angle to the first wheel, where the non-orthogonal angle is formed between two legs, the first leg is the first rail and the second leg is an imaginary line from the first wheel to the first flange camera lens;

the first inside rim camera includes a camera lens, and the camera lens is aimed at a non-orthogonal angle to the first wheel, where the non-orthogonal angle is formed between two legs, the first leg is the first rail and the second leg is an imaginary line from the first wheel to the first inside rim camera lens;

the first outside rim camera includes a camera lens, and the camera lens is aimed at a non-orthogonal angle to the first wheel, where the non-orthogonal angle is formed between two legs, the first leg is the first rail and the second leg is an imaginary line from the first wheel to the first outside rim camera lens;

the second flange camera includes a camera lens, and the camera lens is aimed at a non-orthogonal angle to the second wheel, where the non-orthogonal angle is formed between two legs, the first leg is the second rail and the second leg is an imaginary line from the second wheel to the second flange camera lens;

the second inside rim camera includes a camera lens, and the camera lens is aimed at a non-orthogonal angle to the second wheel, where the non-orthogonal angle is formed between two legs, the first leg is the second rail and the second leg is an imaginary line from the second wheel to the second inside rim camera lens; and the second outside rim camera includes a camera lens, and the camera lens is aimed at a non-orthogonal angle to the second wheel, where the non-orthogonal angle is formed between two legs, the second leg is the second rail and the second leg is an imaginary line from the second wheel to the second outside rim camera lens.

8. The system of claim 1, wherein:

the first flange camera includes a camera lens, and the camera lens is aimed at a non-orthogonal angle to the first wheel, where the non-orthogonal angle is formed between two legs, the first leg is the first rail and the second leg is an imaginary line from the first wheel to the first flange camera lens;

the first inside rim camera includes a camera lens, and the camera lens is aimed at a non-orthogonal angle to the first wheel, where the non-orthogonal angle is formed between two legs, the first leg is the first rail and the second leg is an imaginary line from the first wheel to the first inside rim camera lens; and the first outside rim camera includes a camera lens, and the camera lens is aimed at a non-orthogonal angle to the first wheel, where the non-orthogonal angle is formed between two legs, the first leg is the first rail and the second leg is an imaginary line from the first wheel to the first outside rim camera lens.

9. A method of capturing, measuring and analyzing rolling stock wheel parameters, comprising:

reflecting light toward a first wheel utilizing a backface illumination plate provided between a first rail and a second rail;

capturing an image of at least a portion of said first wheel above the first rail having a flange provided between said first rail and said second rail with a first flange camera provided between said first rail and said second rail;

capturing an image of at least a portion of said first wheel above the first rail with a first inside rim camera provided between said first rail and said second rail; and capturing an image of at least a portion of said first wheel above the first rail, including at least a portion of an internal diameter of the first wheel, with a first outside rim camera provided outside the area between said first rail and said second rail.

10. The method of claim 9, further comprising:

sensing the presence of the first wheel above the first rail with a sensor in communication with at least one of the first flange camera, first inside rim camera and first outside rim camera; and positioning at least one marker to be at least partially included in at least one of the image captured by the first flange camera, the image captured by the first inside rim camera and the image captured by the first outside rim camera.

11. The method of claim 9, further comprising transmitting at least one of the image captured by the first flange camera, the image captured by the first inside rim camera and the image captured by the first outside rim camera, to a data processing unit.

12. The method of claim 9, further comprising:

reflecting light toward a second wheel with a backface illumination plate provided between said first rail and said second rail;

capturing an image of at least a portion of said second wheel above the second rail having a flange provided between said first rail and said second rail with a second flange camera provided between said first rail and said second rail capturing an image of at least a portion of said second wheel above the second rail with a second inside rim camera provided between said first rail and said second rail; and capturing an image of at least a portion of said second wheel above the second rail, including at least a portion of an internal diameter of the second wheel, with a second outside rim camera provided outside the area between said first rail and said second rail.

13. The method of claim 12, further comprising:

sensing the presence of at least one of the first wheel above the first rail and the second wheel above the second rail with a sensor in communication with at least one of the first flange camera, first inside rim camera, first outside rim camera, second flange camera, second inside rim camera and second outside rim camera; and positioning at least one marker to be at least partially included in at least one of the image captured by the first flange camera, the image captured by the first inside rim camera, the image captured by the first outside rim camera, the image captured by the second flange camera, the image captured by the second inside rim camera and the image captured by the second outside rim camera.

14. The method of claim 12, further comprising transmitting at least one of the image captured by the first flange camera, the image captured by the first inside rim camera, the image captured by the first outside rim camera, the image captured by the second flange camera, the image captured by the second inside rim camera and the image captured by the second outside rim camera, to a data processing unit.

15. A method of providing a system for capturing, measuring and analyzing rolling stock wheel parameters, comprising:

positioning and orienting a first flange camera between a first rail and a second rail to capture an image of at least a portion of a first wheel above said first rail having a flange provided between said first rail and said second rail;

positioning and orienting a first inside rim camera between said first rail and said second rail to capture an image of at least a portion of said first wheel above said first rail;

positioning and orienting a first outside rim camera outside the area between said first rail and said second rail to capture an image of at least a portion of said first wheel above said first rail;

positioning and orienting at least one strobe light, such that the at least one strobe light illuminates at least a portion of said first wheel; and positioning and orienting at least one backface illuminate plate between said first rail and said second rail to reflect light from the strobe light toward said first wheel.

16. The method of claim 15, further comprising:

providing at least one sensor, which is in communication with at least one of the first flange camera, first inside rim camera and first outside rim camera; and positioning at least one marker, such that the at least one marker is at least partially visible in an image of at least a portion of the wheel captured by at least one of the first flange camera, first inside rim camera and first outside rim camera.

17. The method of claim 15, further comprising providing a data processing unit, which is in communication with at least one of the first flange camera, first inside rim camera and first outside rim camera.

18. The method of claim 15, further comprising:

positioning and orienting a second flange camera between said first rail and said second rail to capture an image of at least a portion of a second wheel above said second rail having a flange provided between said first rail and said second rail;

positioning and orienting a second inside rim camera between said first rail and said second rail to capture an image of at least a portion of said second wheel above said second rail;

positioning and orienting a second outside rim camera outside the area between said first rail and said second rail to capture an image of at least a portion of said second wheel above said second rail;

positioning and orienting at least one strobe light, such that the at least one strobe light illuminates at least a portion of said second wheel; and positioning and orienting at least one backface illuminate plate between said first rail and said second rail to reflect light from the strobe light toward said second wheel.

19. The method of claim 18, further comprising:

providing at least one sensor, which is in communication with at least one of the first flange camera, first inside rim camera, first outside rim camera, second flange camera, second inside rim camera and second outside rim camera; and positioning at least one marker, such that the at least one marker is at least partially visible in an image of at least a portion of the wheel captured by at least one of the first flange camera, first inside rim camera, first outside rim camera, second flange camera, second inside rim camera and second outside rim camera.

20. The method of claim 18, further comprising providing a data processing unit, which is in communication with at least one of the first flange camera, first inside rim camera, first outside rim camera, second flange camera, second inside rim camera and second outside rim camera.

* * * * *